US008381904B1

(12) United States Patent
Longinotti-Buitoni

(10) Patent No.: US 8,381,904 B1
(45) **Date of Patent: *Feb. 26, 2013**

(54) PROTECTIVE COVERING FOR PERSONAL ELECTRONIC DEVICE

(76) Inventor: Kip Longinotti-Buitoni, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/286,257

(22) Filed: Nov. 1, 2011

Related U.S. Application Data

(63) Continuation of application No. 12/848,548, filed on Aug. 2, 2010, now Pat. No. 8,047,364, which is a continuation of application No. 12/619,629, filed on Nov. 16, 2009, now abandoned.

(60) Provisional application No. 61/114,689, filed on Nov. 14, 2008.

(51) Int. Cl.
*B65D 65/02* (2006.01)

(52) U.S. Cl. ..... 206/320; 206/38; 455/575.8

(58) Field of Classification Search ..... 206/320, 206/305, 701, 38; 455/575.8; 150/131, 132; 224/929, 930

See application file for complete search history.

(56) References Cited

U.S. PATENT DOCUMENTS

| | | | | | |
|---|---|---|---|---|---|
| 3,949,916 | A * | 4/1976 | Yount | 224/240 |
| 3,958,690 | A * | 5/1976 | Gee, Sr. | 206/232 |
| 4,071,065 | A * | 1/1978 | Halbich | 206/320 |
| 5,080,223 | A * | 1/1992 | Mitsuyama | 206/39.5 |
| 5,265,720 | A * | 11/1993 | Meliconi | 206/305 |
| 5,360,108 | A * | 11/1994 | Alagia | 206/320 |
| 5,445,199 | A * | 8/1995 | Jia | 150/136 |
| 6,102,266 | A * | 8/2000 | Chacon et al. | 224/679 |
| D459,346 | S * | 6/2002 | Powell | D14/250 |
| 6,616,111 | B1 * | 9/2003 | White | 248/309.1 |
| 6,634,494 | B1 * | 10/2003 | Derr et al. | 206/305 |
| 6,646,864 | B2 * | 11/2003 | Richardson | 361/679.3 |
| 6,669,014 | B2 * | 12/2003 | Onmori et al. | 206/232 |
| 6,845,863 | B1 * | 1/2005 | Riley | 206/39 |
| 6,935,497 | B1 * | 8/2005 | Domotor et al. | 206/320 |
| 7,204,398 | B1 * | 4/2007 | Smith, Sr. | 224/607 |
| D574,819 | S * | 8/2008 | Andre et al. | D3/269 |
| 7,464,814 | B2 * | 12/2008 | Carnevali | 206/320 |
| D597,089 | S * | 7/2009 | Khan et al. | D14/250 |
| D619,130 | S * | 7/2010 | Fellig | D14/250 |
| D626,119 | S * | 10/2010 | Fellig | D14/250 |
| D631,246 | S * | 1/2011 | Boettner | D3/218 |
| 8,047,364 | B2 * | 11/2011 | Longinotti-Buitoni | 206/320 |
| D653,656 | S * | 2/2012 | Charnas et al. | D14/250 |
| 2002/0175096 | A1 * | 11/2002 | Linihan | 206/305 |
| 2004/0173482 | A1 * | 9/2004 | Nieves | 206/320 |
| 2007/0057004 | A1 * | 3/2007 | Butler et al. | 224/669 |
| 2007/0215663 | A1 * | 9/2007 | Chongson et al. | 224/930 |
| 2007/0223183 | A1 * | 9/2007 | Oja | 361/681 |
| 2008/0121322 | A1 * | 5/2008 | Thomson | 150/143 |
| 2008/0142129 | A1 * | 6/2008 | Reasner et al. | 150/131 |

* cited by examiner

*Primary Examiner* — Steven A. Reynolds

(74) *Attorney, Agent, or Firm* — Andrew S. Langsam; Pryor Cashman LLP

(57) ABSTRACT

A personal electronic device protective wallet covering. A main housing is dimensioned to fit securely and snugly around a personal electronic device. The main housing includes a window disposed on a front side of the housing allowing usable access to a front surface of a device disposed in the housing. A rear protective face at least partially covers a rear surface of the device disposed inside. A preferably externally accessible pocket is formed coextensively with the rear protective face, adapted to allow insertion and removal of cards or paper currency into and out of the pocket in the manner of a wallet. The window may be an absence of housing material, allowing direct user contact with the front of the device, or it may thin and transparent, allowing functional contact therethrough. The pocket may be formed between the housing and the device or between the housing and an additional layer.

6 Claims, 10 Drawing Sheets

PROTECTIVE COVERING FOR PERSONAL ELECTRONIC DEVICE

RELATED APPLICATIONS

This continuation application claims priority from U.S. patent application Ser. No. 12/848,548 which was filed on Aug. 2, 2010 and issued on Nov. 2, 2011 as U.S. Pat. No. 8,047,364. The issued US patent is based on an application which claimed priority on U.S. patent application Ser. No. 12/619,629, filed Nov. 16, 2009, which itself claims priority from U.S. Provisional Patent Application No. 61/114,689, entitled "Protective Covering for Electronic Device" and filed Nov. 14, 2008, the entirety of all of which is hereby incorporated by reference.

BACKGROUND OF THE INVENTION

1. Field of the Invention

The invention relates to protective coverings for personal digital/data assistants (PDAs), cellular telephones, and similar portable and/or hand-held electronic devices. More specifically, the invention relates to protective coverings for PDAs that are capable of also carrying other items as well as the PDA.

2. Description of Related Art

In many countries, the majority of the population carries at least one hand-held or otherwise portable electronic device, such as a cell phone, a PDA (e.g., a Blackberry®, made by Research in Motion, Ltd., of Waterloo, Ontario, Canada, and/or an iPhone®, made by Apple, Inc., of Cupertino, Calif.), or similar device which carries both their personal and business data (hereinafter collectively and generically "PDAs" or "personal electronic devices"). There has been a trend towards combining several functions of different types within the same device so as to minimize pocket or purse clutter and to make the products more integrated, useful and convenient. There has also been a trend to shrink the size of PDAs to make them as portable as possible, preferably pocket-sized (meaning, able to fit within the average person's pants pocket comfortably).

However, if one is out and about with one's cell phone or PDA, one still must carry a wallet for one's cash, credit cards, train passes, identification cards or badges, and the like. The greater the number of such items a person carries around, the greater the likelihood that she will either forget one or more of the items at home, and the greater the likelihood that she will misplace one in a restaurant, bar, office, etc. Even were one not to lose or misplace anything, fumbling around looking for a wallet while holding a PDA or vice versa wastes time, is uncomfortable for the user, and reduces the "cool" factor of having a cutting edge PDA. There is a long-felt need to somehow make carrying a PDA even more convenient and efficient.

A number of different types of protective coverings are available for PDAs. For example, see: US Patent Application No. 2007/0223183 to Oja; US Patent Application No. 2007/0215663 to Chongson et al.; US Patent Application No. 2002/0101411 to Chang; U.S. Pat. Nos. 6,892,880 to Nieves; 6,758,335 to Kajiya; 6,483,697 to Jenks et al.; 6,445,577 to Madsen et al.; 6,347,796 to Grossman et al.; 6,239,968 to Kim et al.; 5,348,347 to Shink; or 5,006,699 to Felkner et al. These conventional coverings tend to fall into four general categories: a soft covering or "skin" that hugs the contour of the PDA, made from a resilient material such as silicone rubber; hard shell cases made from plastic or metal; flip/folio-style coverings that provide an openable and closeable front cover over the PDA; and camera-case style bags that are usually soft, pliable, cushioned, and significantly larger than the PDA itself.

Each of these categories has its drawbacks. The first category, the "skin" covering is quite popular, however it serves only to cover the device; it cannot hold anything else.

The second category, hard clamshell-style cases, includes the abovementioned Chang US patent application and the abovementioned Kajiya, Madsen, Jenks, and Kim et al. US patents. While these cases may protect the PDA inside, they must be fully opened in order to use the PDA. Also, these cases are not designed to hold anything but the PDA itself.

The third category is flip/folio-style cases; this category includes the abovementioned Oja US patent application and the abovementioned Nieves, Grossman, Shink, and Felkner US patents. As with the clamshell cases, a cover flips open and closed over the PDA, usually with a securing mechanism such as a snap, a magnet, or hook and loop fasteners (e.g., Velcro®). In order to use the PDA, the cover must be opened, thereby exposing the front of the device. This is inconvenient. Additionally, the presence of a flip-openable cover adds such a significant amount of bulk to the otherwise pocket-sized PDA so as to render it less convenient to carry. As an example, the Shink patent teaches a diaper-bag-like roll that has not one fold-over flap of a cover but four fold-over panels. Also, the majority of this style of case can only hold the PDA itself, although some such as Felkner, Nieves, and Shink may have an internal pocket. By providing a pocket internal to the case, the case must be opened in order to access the pocket. This is inconvenient, and risks injury to the PDA for the sake of accessing the pocket.

Finally, the fourth category of camera-bag-style coverings includes the above-mentioned Chongson et al. US patent application. This style likely offers the most protection (depending on the amount of cushioning provided), however it is potentially the most dangerous and the least convenient. For one, not only cannot the user use the PDA when the bag is closed, the PDA must be wholly removed from the safety of the bag in order to be used. Thus, in order to use the PDA, the user must render the PDA complete susceptible to catastrophic damage (e.g., by dropping it). Moreover, the bagstyle covering is so large as to render the PDA no longer so small to be convenient; for example, in Chongson, the bag is so large, the user must wear the bag with the PDA inside. It is no longer pocket-sized, and thus unacceptable for many users; one may as well carry a backpack or a suitcase.

Thus, there is a long-felt need to provide a PDA cover that protects the device, and makes the device more convenient and efficient, while keeping true to the pocket-sized portable and personal nature of a PDA.

SUMMARY OF THE INVENTION

The invention is a protective covering for a personal electronic device such as the devices mentioned above. More specifically, the invention is a personal electronic device protective wallet covering.

In one embodiment, the covering includes a main housing having an inner housing configuration dimensioned to fit securely around a personal electronic device having an outer physical device configuration. The main housing includes a primary window disposed on a front side of the housing allowing usable access to a front surface of a personal electronic device disposed in the housing. The main housing also includes a rear protective face at least partially covering a rear surface of the personal electronic device disposed in the housing. In the preferred embodiment, at least a first portion of the rear protective face is disposed a distance away from the rear surface of the personal electronic device in the housing so as to form a pocket between the rear protective face of the housing and the rear surface of the personal electronic device disposed therein. At least one pocket access slot is formed in the main housing, preferably in the rear protective face, and in communication with the pocket; the slot allows access to the pocket, i.e., insertion and removal of cards or paper currency or the like into and out of the pocket in the manner of a wallet.

In this embodiment, preferably, the rear protective face further includes a second portion disposed substantially in contact with, and not a distance away from, the rear surface of the personal electronic device in the housing. Preferably, the pocket-forming first portion is substantially centrally located on the rear protective face and the second portion at least partially surrounds the first portion so as to define an inner shoulder around the pocket.

The main housing may be pliable and elastic in the manner of a conventional PDA "skin" made from silicone or the like. Alternatively, it may be made from a substantially rigid, inelastic, but at least slightly resilient material and be more in the form of a hard shell.

The primary window on the housing may be formed from an absence of housing material on a front face of the main housing, thereby allowing direct user access to the front surface of the personal electronic device in the housing. Alternatively, the primary window may be made from a transparent material through which a user can access (e.g., by pressure or body heat) the front surface of the personal electronic device in the housing.

The rear protective face may include at least one secondary window. Depending on its dimensions, the secondary window can serve to reveal the contents of the pocket (e.g., an identification card) without allowing the contents to fall out, or it may serve to reveal simply that there are contents in the pocket without revealing too many details about the contents. Optionally, the secondary window may be primarily decorative. A stiff panel may be provided secured to an inner surface of the first portion of the rear protective face. The panel preferably has a smooth surface facing the rear surface of the personal electronic device to facilitate removal of the contents from the pocket. Additionally or in the alternative, the pocket-access slot may further include a finger cut-out portion adapted to expose a portion of the contents disposed in the pocket and facilitate a user grasping and removing the contents from the pocket.

More generally, the invention is a personal electronic device protective wallet covering, with a main housing having an inner housing configuration dimensioned to fit securely around a personal electronic device having an outer physical device configuration. The main housing includes a primary window disposed on a front side of the housing allowing usable access to a front surface of a personal electronic device disposed in the housing. The main housing also includes a rear protective face at least partially covering a rear surface of the personal electronic device disposed in the housing. A pocket is formed coextensively with the rear protective face, adapted to allow insertion and removal of cards or paper currency into and out of the pocket in the manner of a wallet.

The pocket may include at least one second rear layer secured to at least one of an outer surface or an inner surface of the rear protective face on at least a majority of a perimeter of the second rear layer but not the entire perimeter of the second rear layer, thereby leaving an opening through which cards or paper currency can be inserted into or removed from the pocket. In the case where the second rear layer is secured to the outer surface of the rear protective face, the second rear layer may be substantially transparent to allow the contents of the pocket to be visible from outside the pocket. Optionally, a stiff panel is disposed within the pocket and secured to one of the rear protective face or the second rear layer. The stiff panel preferably has a smooth surface facing the other of the rear protective face or the second rear layer so as to facilitate removal of the contents from the pocket. In the case where the second rear layer is disposed atop the rear protective surface of the main housing and made transparent, the stiff panel would be secured to the rear protective surface of he main housing so as not to obscure the transparency of the second rear layer.

In one embodiment, the rear protective includes at least a first portion disposed a distance away from the rear surface of the personal electronic device in the housing so as to form the pocket between the rear protective face and the rear surface of the personal electronic device. In this case, the rear protective face preferably further comprises a second portion disposed substantially in contact with, and not a distance away from, the rear surface of the personal electronic device in the housing. The first portion is preferably substantially centrally located on the rear protective face, and the second portion at least partially surrounds the first portion so as to define an inner shoulder around the pocket.

The rear protective face may include at least one secondary window. Depending on its dimensions, the secondary window can serve to reveal the contents of the pocket (e.g., an identification card) without allowing the contents to fall out, or it may serve to reveal simply that there are contents in the pocket without revealing too many details about the contents. Optionally, the secondary window may be primarily decorative.

As above, the main housing may be pliable and elastic or may be a hard shell made from a substantially rigid, inelastic, but resilient material. As above, the primary window may be an absence of material on a front face of the main housing allowing direct user access to the front surface of the personal electronic device in the housing. Alternatively, the primary window may be a transparent material through which a user can access the front surface of the personal electronic device in the housing.

The benefits of the invention are manifold. First, the invention protects the PDA from damage from being dropped or spilled on or scratched while doubling as a small wallet/billfold residing directly on the PDA atop/within the covering. The simplicity of the design keeps the overall profile of the PDA slim and pocket-sized, while also allowing pertinent cards and money to be in one place alongside one's PDA. The invention also eliminates the need to carry both a PDA and a separate wallet or billfold. Finally, by providing the primary front window, the inventive wallet covering enables permanent and constant usage of the PDA inside the covering without removing the PDA from the housing (as in the camera case-style previous attempts) or opening any portion of the housing (as in the flip folio-style previous attempts). Thus, the inventive wallet covering protects the PDA even during use and not risking catastrophic damage by not requiring removal of the protective housing from the PDA.

DETAILED DESCRIPTION OF THE INVENTION AND DRAWINGS

Description of the invention will now be given with reference to FIGS. 1-7. It should be understood that these figures are exemplary in nature and in no way serve to limit the scope of the invention, which is defined by the claims appearing hereinbelow.

Figure 2A:
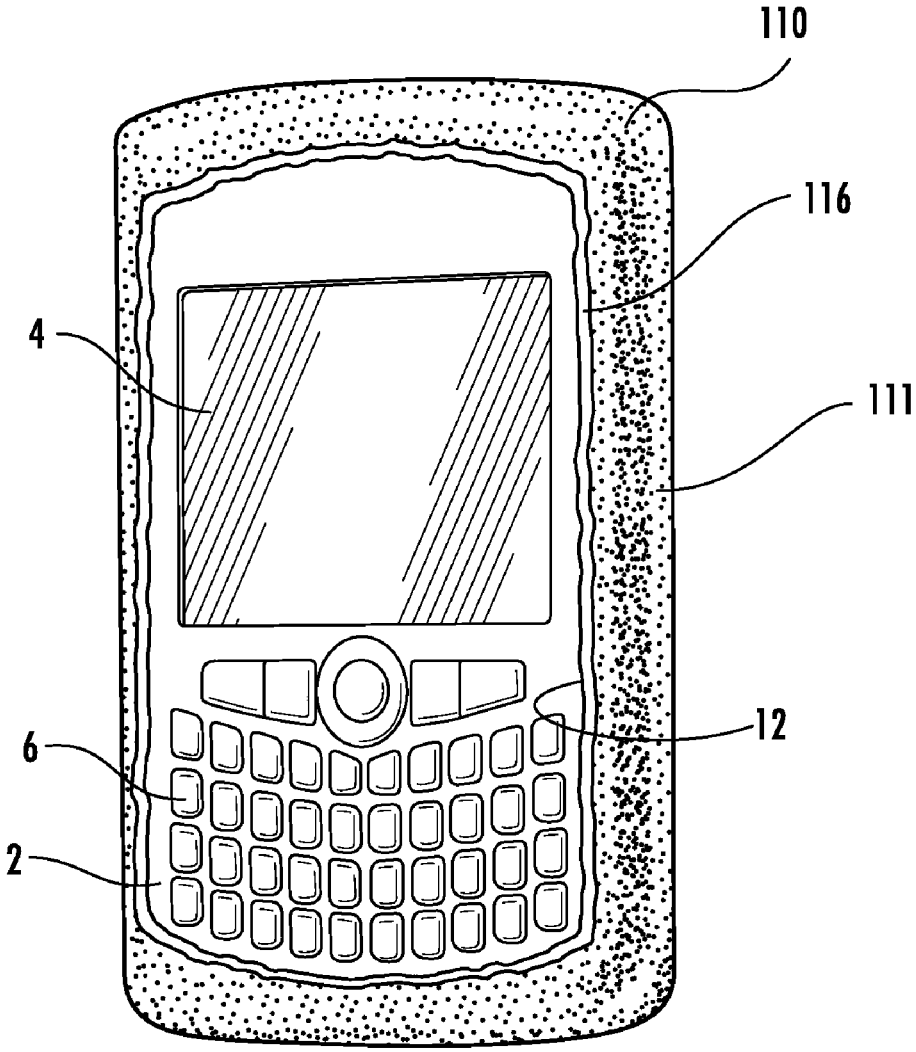
FIG. 2A is a front perspective view of another electronic device protective wallet covering in accordance with the invention.
Figure 2B:
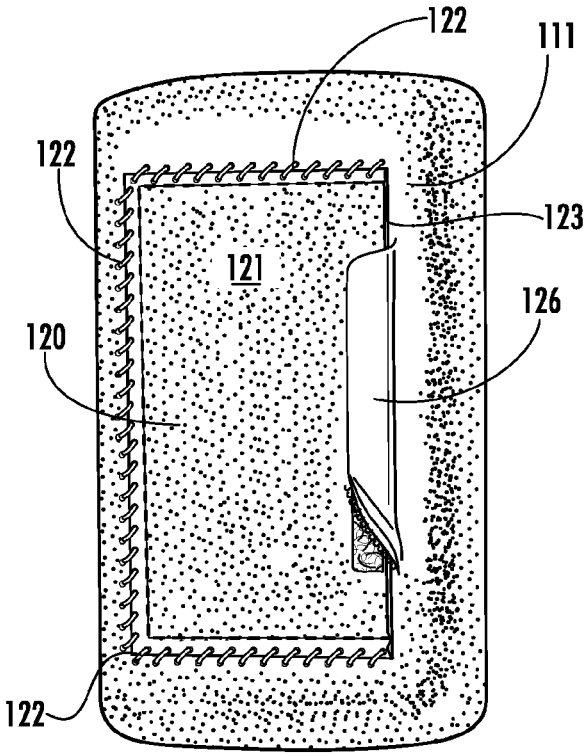
FIG. 2B is a rear perspective view of the protective wallet covering of FIG. 2A.
Figure 3:
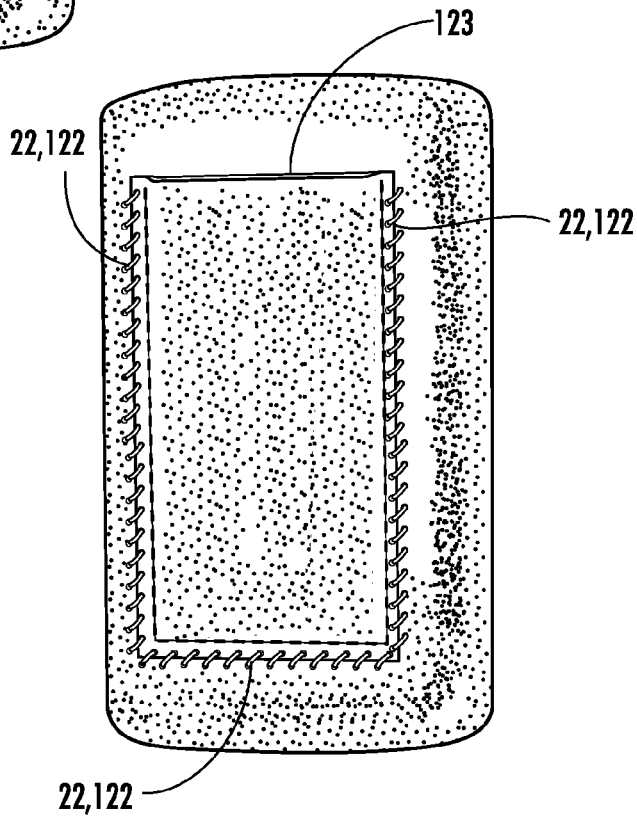
FIG. 3 is a rear perspective view of another alternate configuration of an electronic device protective wallet covering in accordance with the invention.

FIGS. 1-3 depict a wallet coverings 10 and 110 in accordance with the invention. The pliable covering or skin surrounds at least most of the electronic device, e.g., the back, the sides, the top and bottom. Preferably, the covering leaves the front of the device exposed, i.e., has a front window, so that it may be used in a normal manner. Optionally, the covering also covers the front of the device, but the material of at least the portion of the covering that covers the front of the device is sufficiently thin and transparent so as to enable usage of the device even with the covering over the front thereof. The covering is usually made form a rubber-like thin material so that it can be stretched over the PDA and held in place without fasteners.

The covering includes a flat pocket formed on the backside of the covering to enable the carriage of credit cards, business cards, and cash. The pocket here is formed as an extra layer or flap of the pliable material atop the backside of the covering. The pocket is substantially secured to the main body of the covering on at least a majority of the perimeter of the pocket but not the entire perimeter of the pocket leaving an opening, thereby enabling user access to the space between the extra layer or panel, i.e., enabling the user to place items inside the pocket through the opening. For example, if the pocket were rectangular in shape, three of the four sides of the extra layer or flap would be sealed or secured to the main body of the covering.

The covering may also include a thin stiff support sheet or panel disposed within the pocket to facilitate removal of the pocket's contents and prevent the contents from sticking to either the main body or the extra flap. Further, the support sheet also serves to separate the main body from the extra flap and prevent sticking therebetween, thereby ensuring easy access into the pocket as well.

The inventive covering may be made from a pliable, stretchable silicone rubber, or a polymer such as polyurethane or the like. Using this material, the extra layer or panel is preferably glued, heat-sealed, or secured in any other appropriate manner to the main body of the covering. Alternatively, the covering may be made from a fabric, such as nylon, and provided with a rubberized or otherwise stretchable border around the open front window. Using these materials, the extra layer or panel may be glued, sewn, or secured in any other appropriate manner to the main body of the covering.

The pocket may be formed on the outside of the covering. This provides easy access to the contents of the pocket without requiring the removal of the covering from the PDA. Optionally, either the extra panel or the stiff inner panel are substantially opaque to conceal the contents of the pocket and decrease the probability of the theft of the device or the contents of the pocket. As another option, the extra panel may be made from a substantially transparent material, so that an identification card or the like may be functionally visible from the outside without removing it from the pocket.

Alternatively, the pocket may be formed on the inside of the covering. This is less convenient for access, however it has the added benefit of being hidden; it is less likely an unauthorized person would find the contents of the pocket or even know of the pocket's existence with an internal pocket. Optionally, both inside and outside pockets may be provided in the same covering.

Figure 1A:
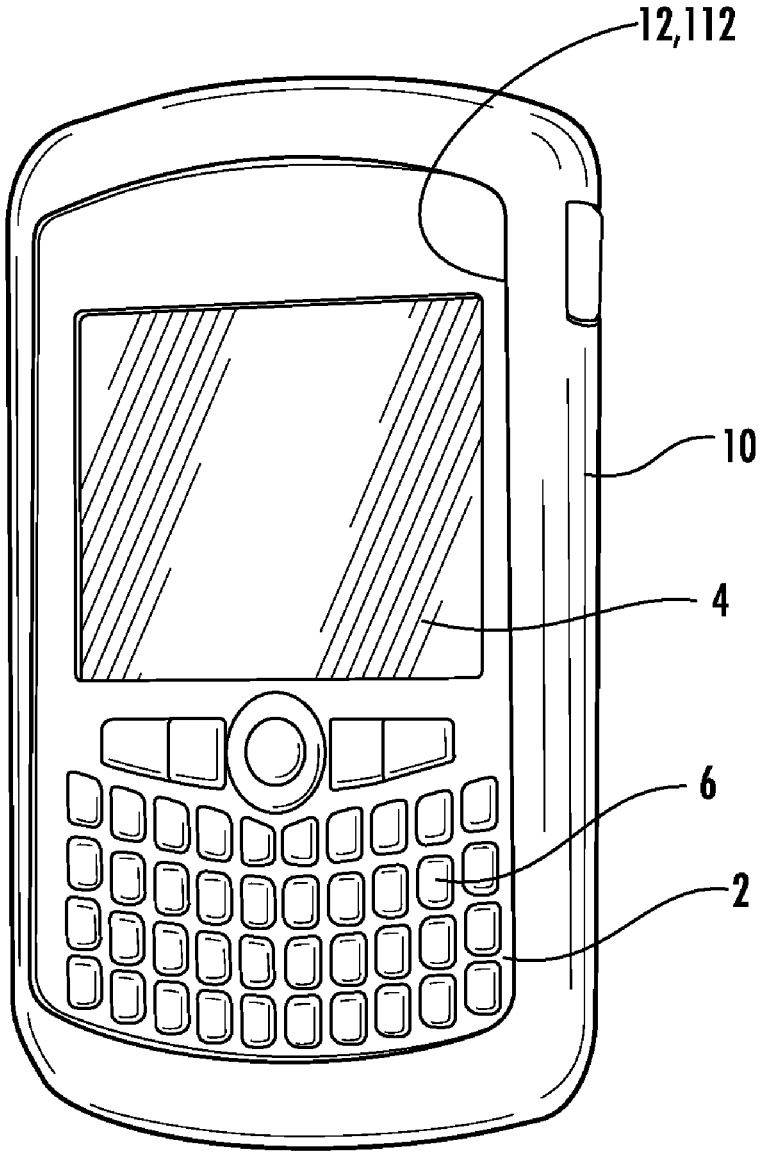
FIG. 1A is a front perspective view of an electronic device protective wallet covering in accordance with the invention.

With specific reference to the drawings, as shown in FIG. 1A, a typical PDA 2 includes a display screen 4 and buttons or a keyboard 6. Of course, PDA 2 may have a touchscreen instead of or in addition to actual buttons or keyboard 6; a virtual keyboard can be provided on the touch screen. In any event, inventive skin or covering 10 is disposed snugly around PDA 2. On the front side, covering 10 preferably includes a primary window 12 which allows the user to be able to access keyboard/touchscreen 6 and see display 4. Window 12 may be an opening (i.e., an absence of material); alternatively, window 12 may include a thin, light transmissible material 112 that will be sufficiently thin and transparent to allow a user to use keyboard 6 and see display screen 4 even through section 112. (Some opening in main housing 11 will be required to enable covering 10 to be secured around PDA 2.) In either event, window 12 (with or without material 112) enables the user to use the PDA even when covered by covering 10. Some PDAs are provided with a small speaker or a camera; a hole or series of small holes (not shown) may be formed in covering 10 to allow sound from the speaker to be heard clearly and in an unmuffled fashion, or to allow the camera to function. Covering 10 may also have holes 14 (see FIG. 1B) on one or more sides, the top, the back, or bottom locations to allow the user to access any buttons, camera lenses, or the like that may be provided on PDA 2. Each different model or make of PDA 2 will preferably have a corresponding covering 10 that has the appropriate overall shape as well as holes that correspond to the relevant buttons and features.

Figure 1B:
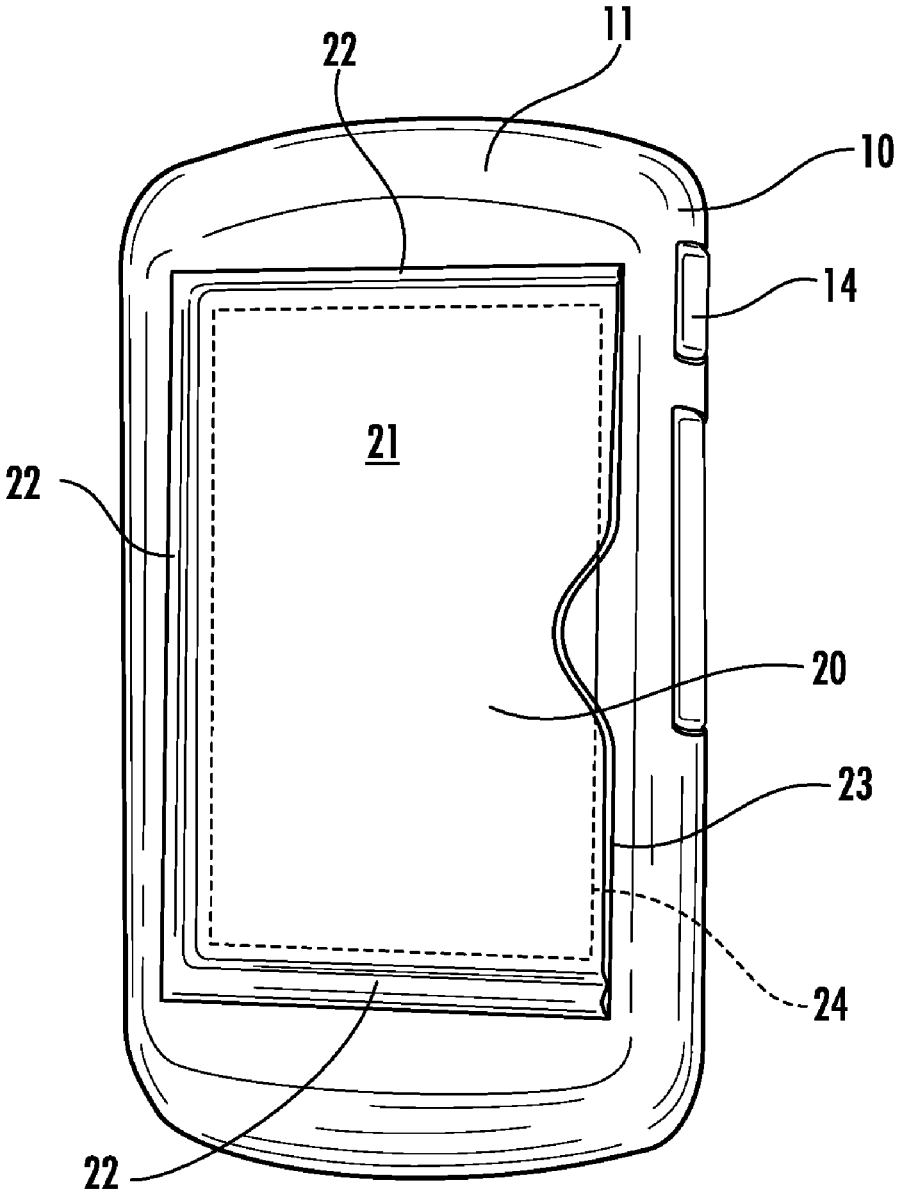
FIG. 1B is a rear perspective view of the protective wallet covering of FIG. 1A.

FIG. 1B depicts the rear side of covering 10. The rear side of covering 10 is provided with pocket 20, formed from second layer or panel 21 being sealed or secured to main housing 11 of covering 10 at seams 22. Seams 22 may be heat seals, adhesive seals, threaded seams, or any other type of securing method. It is preferred, however, that the securing method used to create seams 22 does not significantly add to the thickness of covering 10, since it is preferred to minimize the overall profile of a PDA encased in covering 10 and keep it pocket-sized, i.e., not noticeably larger than the PDA itself. Regardless of the method employed, it is preferred that a majority of the perimeter of panel 21 be secured to main housing 11, but not the entirety of the perimeter. So, for example, in the embodiment shown in FIG. 1B having a rectangular panel 21, only three sides of panel 21 are secured to main housing 11 at seams 22, thereby allowing access into the interior of pocket 20 via the unsealed side 23. Panel 21 may be of any shape, so long as at least a portion of its perimeter is not secured to main housing 11 to allow access therebetween.

One contemplated material for covering 10 is silicone rubber or a similar pliant, flexible, stretchable material. It is preferred that panel 21 of pocket 20 be made from the same material, but other materials can be used. One option is to make panel 21 from an opaque material so that the contents of pocket 20 are hidden; theft is thus deterred. As another option, panel 21 is made from a substantially transparent material so that an identification card, a train or bus pass, or the like can be functionally visible while still inside pocket 20 and without needing to be removed therefrom.

Optionally, a thin, relatively hard, smooth, and inflexible sheet or panel 24 is provided inside pocket 20, secured to either flap 21 or the rear surface of main housing 11. Panel 24 is provided to prevent flap 21 from sticking to main body 11 and thus hampering access to pocket 20. So as to prevent panel 24 from coming out of pocket 20, it is preferred that panel 24 be adhered or otherwise secured to one of main housing 11 or flap 21.

Because panel 24 is smooth (preferably much smoother than the silicone rubber flap or main body), panel 24 provides a slippery surface against which cards, currency, etc. may be easily inserted and removed. Yet despite the ease of inserting and removing items into and out of pocket 20, the high coefficient of friction provided by the other interior surface of pocket 20 (i.e., the exterior surface of main body 11), items placed inside the pocket will remain inside the pocket until a person reaches inside the pocket to retrieve them. Panel 24 is preferably made from an inexpensive hard plastic such as polypropylene, polystyrene, resin- or acrylic-based substances, their bioplastic counterparts, and the like. Alternatively, a slippery yet flexible panel or sheet such as vinyl may be used. In either event, it is preferred that panel 24 be as thin as possible so as to minimize the overall profile or thickness of a PDA secured inside covering 10. In addition, panel 24 can be opaque so as to hide the contents of pocket 20 from outside view.

Figure 1C:
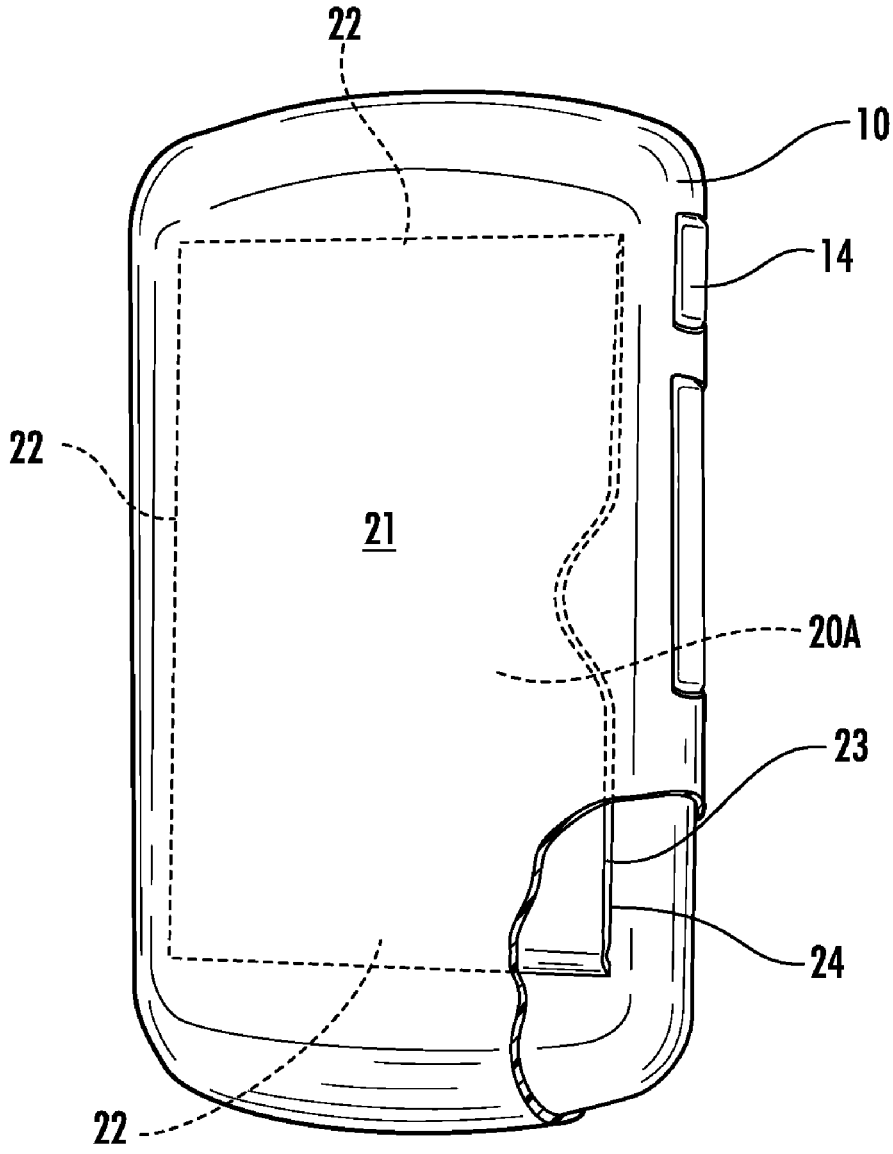
FIG. 1C is an alternate configuration of the protective wallet covering of the invention.

FIG. 1C shows an alternate configuration of the invention. Here, pocket 20A is formed on the interior surface of covering 10; flap 21 is in dotted lines because it is hidden from view. In all other respects, pocket 20A is substantially identical to pocket 20. Pocket 20 provides the user with easy access to the contents of the pocket without having to remove covering 10 from PDA 2. Pocket 20A is not as convenient to use, however pocket 20A has the added feature of being hidden; thus, it is more difficult for a would-be thief to locate. It is also contemplated that a given covering 10 may be provided with both an external pocket 20 and an internal pocket 20A. One might place small bills and less important cards in the external pocket 20 while hiding larger bills and more important cards in the internal pocket 20A.

FIGS. 2A-B show a slight modification for the inventive covering. Here, covering 110 includes a main housing 111 made from a fabric-like material such as nylon, polyester, or the like. As above, it is provided with primary window 12 to allow access to keyboard 6 and display screen 4 of PDA 2. Surrounding the perimeter of window 12 is an elastic band 116 (see FIG. 2A) which keeps main housing 111 secure and snug around PDA 2. On the obverse, panel 121 is attached to main housing 111 to form pocket 120. Panel 121 is sewn or otherwise attached as above, i.e., around the majority of the perimeter of panel 121 at seams 122. Edge 123 is left unattached to allow one to access the interior of pocket 120. If the fabric chosen is sufficiently slippery, an internal sheet or panel such as sheet 24 may not be required. However, to avoid the contents of pocket 120 from unintentionally falling out, a fastener 126 may be provided to selectively close the free unsealed edge 123 of panel 121. Fastener 126 may take the form of a dot or strip of a hook and loop fastening system such as Velcro®, or it may be a reusable adhesive, or it may have a longitudinal tongue and groove configuration similar to reclosable plastic food storage bags (e.g., of the type manufactured by S.C. Johnson & Son, Inc. under the Ziploc® brand). Again, whatever fastening device serves as fastener 126, it is preferred that it not add significantly to the overall thickness or profile of PDA 2 disposed inside covering 110. As above, covering 110 may be provided with an internal pocket (not shown) in addition to or in the alternative to external pocket 120.

Other modifications are contemplated. For example, in both FIGS. 1 and 2, the pockets are shown to be rectangular with one of the long sides left free and unsecured to the main body of the covering. However, as shown in FIG. 3, a short side may be left free and unsecured as edge 23 or 123, leaving the other three sides to be attached to the main body via seams 22 or 122. Indeed, the shape of the pocket need not be rectangular but may be any shape.

As another modification, the protective wallet covering need not have a secondary layer or panel either atop or beneath the rear protective surface of the main housing. Instead, a pocket may be formed as a void volume or gap between the rear protective surface of the main housing and the rear surface of a PDA disposed inside the covering. A wallet covering having this feature is shown in FIGS. 4-7.

Here, as shown best in FIG. 4, cover 210 has a main housing 211 with a primary window 212 formed in front face 211A and a rear protective face 211B on the back. Side faces 211C (FIG. 4D) and top and bottom faces 211D (FIG. 4F) are also preferably provided for maximum protection. One or more of the front, side, top, or bottom faces 211A,C, D may be eliminated as will be explained below. As above, a variety of functional apertures 250 are preferably provided in the main housing 211 so as to allow the user to access the various buttons, ports, and the like of the PDA disposed inside, or so as not to cover a camera, a speaker, etc.

Figure 4A:
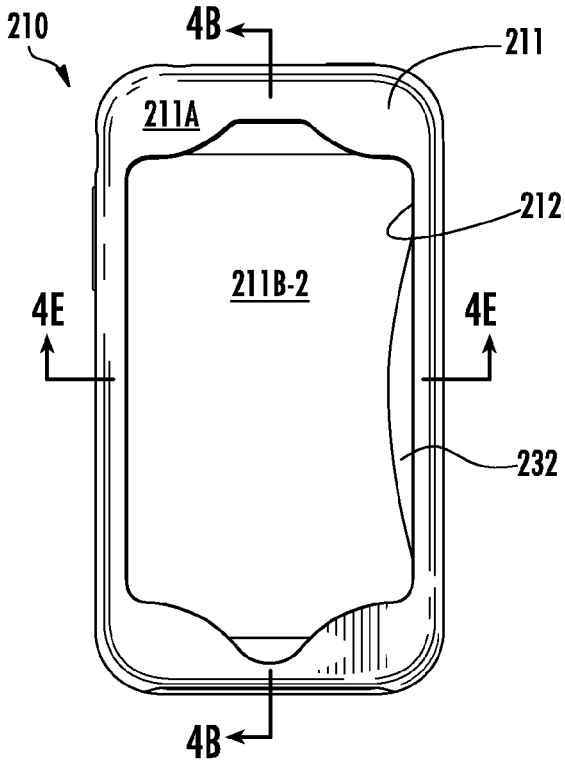
FIGS. 4A-F are various elevation (FIGS. 4A, C, D, and F) and sectional (FIGS. 4B and E) views of an electronic device protective wallet covering in accordance with the invention.
Figure 4B:
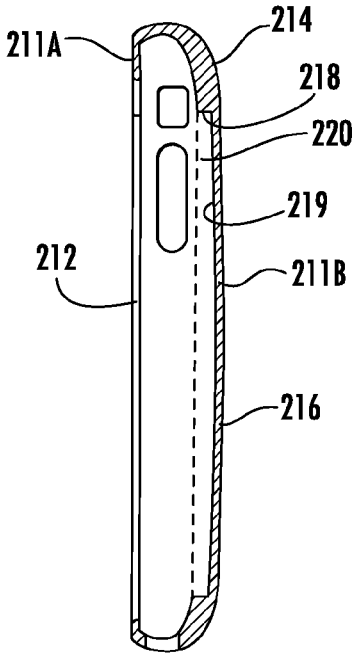
Figure 4C:
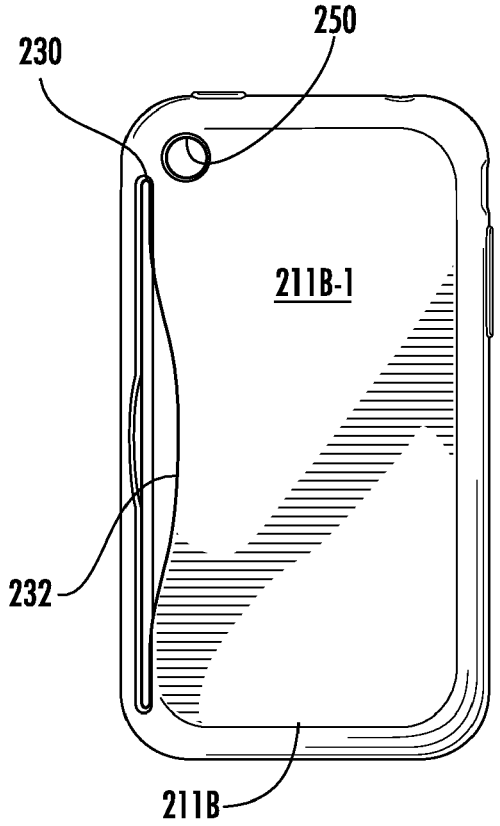
Figure 4D:
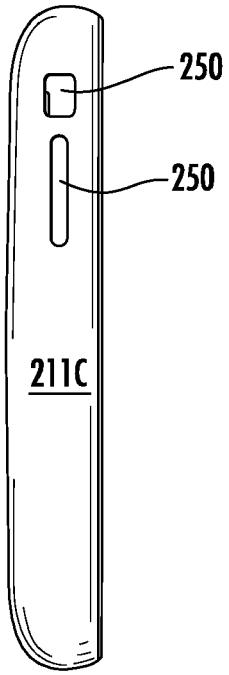
Figure 4E:
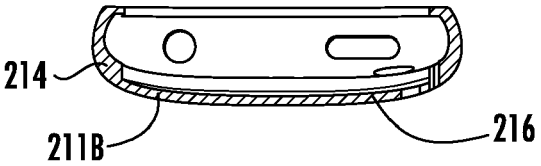
Figure 4F:
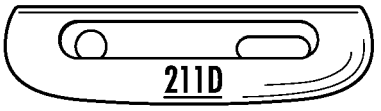

As best illustrated in the sectional views of FIGS. 4B and 4E, rear protective face 211B has two regions: a first region 216 and a second region 214. The second region 214 is dimensioned so as to abut against the rear surface of a PDA placed inside housing 211, however the first region 216 is disposed a small distance away from the second region 214 and thus a small distance away from the rear surface of a PDA inside the housing (as depicted in FIG. 4B in dotted lines). This two-tiered structure of rear protective face 211B creates a shoulder 218 where the first and second regions 216 and 214 meet and creates a well 219 within first region 216 with respect to second region 214. When a PDA is placed inside covering 210, well 219 forms pocket 220 between the rear surface of the PDA and the inner surface 211B-2 of rear protective face 211B.

Figure 5:
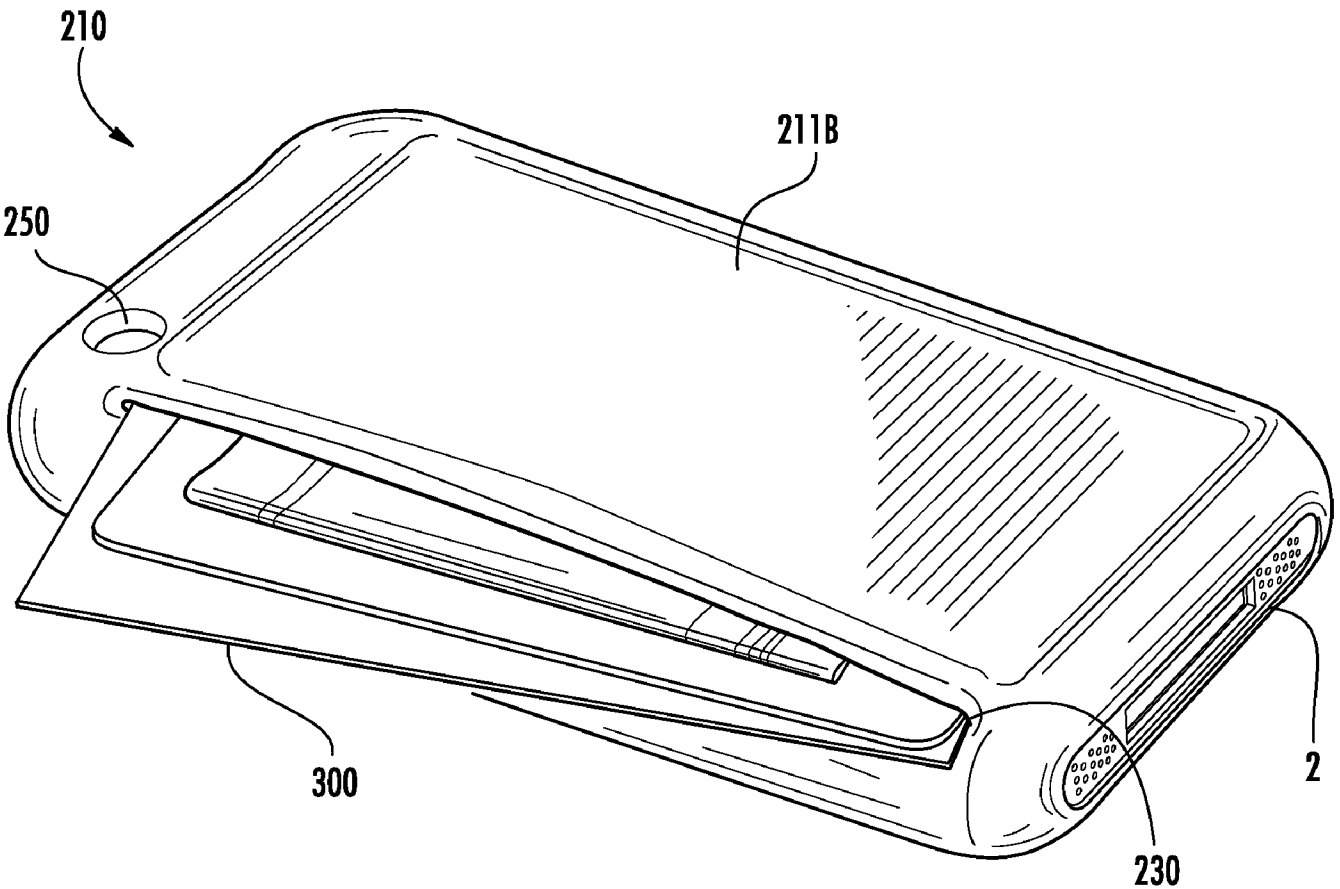
FIG. 5 is a perspective view of the covering of FIG. 4 in use covering a PDA and retaining contents in its pocket.

The preferred depth of well 219 (i.e., the height of shoulder 218) will depend on the size of the overall dimensions of housing 211. As an example, for an embodiment designed for an iPhone® 3G, well 219 is about 4 mm deep, sufficient to accommodate a few cards and/or banknotes as contents 300 (see FIG. 5) without significantly increasing the overall profile of the PDA, and thus maintaining the PDA's pocket-sized, portable, and personal nature and appeal. If covering 210 is made from an elastic, pliable material, such as silicone rubber, then well 219 may stretch a bit to accommodate more cards, currency, etc., as shown in FIG. 5 (note slot 230 bowing slightly to accommodate contents 300). If covering 210 is made from a hard shell-type material, the material may still be a bit resilient (e.g., hard plastic or thin sheet metal), and a resilient hinge may be provided at the top or bottom or sides, as will be described below.

To maximize the convenience of protective wallet covering 210, it is preferred that the user be able to access pocket 220 from the outside of covering 210 without removing it from the PDA. To that end, a pocket access slot 230 is formed in and fully through rear protective face 211B, from external surface 211B-1 to external surface 211B-2. Pocket access slot 230 is in communication with well 219, and thus pocket 220, so that a user may grab a card or the like disposed inside pocket 220 and remove it, or insert a card or the like into pocket 220 via access slot 230. Slot 230 is preferably provided with a finger cut out 232 so as to expose a small portion of the contents and make it easier for the user to obtain a finger purchase on the contents and remove them from pocket 220.

FIGS. 4-5 depict rear protective face 211B as substantially covering the PDA and contents, however it does not have to cover the PDA and contents completely. As mentioned above, it may be advantageous to make contents 300 at least partially visible even while disposed in pocket 220. For example, one may wish to be able to show identification (e.g., a driver's license, a commuting pass, etc.) without removing the identification from pocket 220.

Figure 6B:
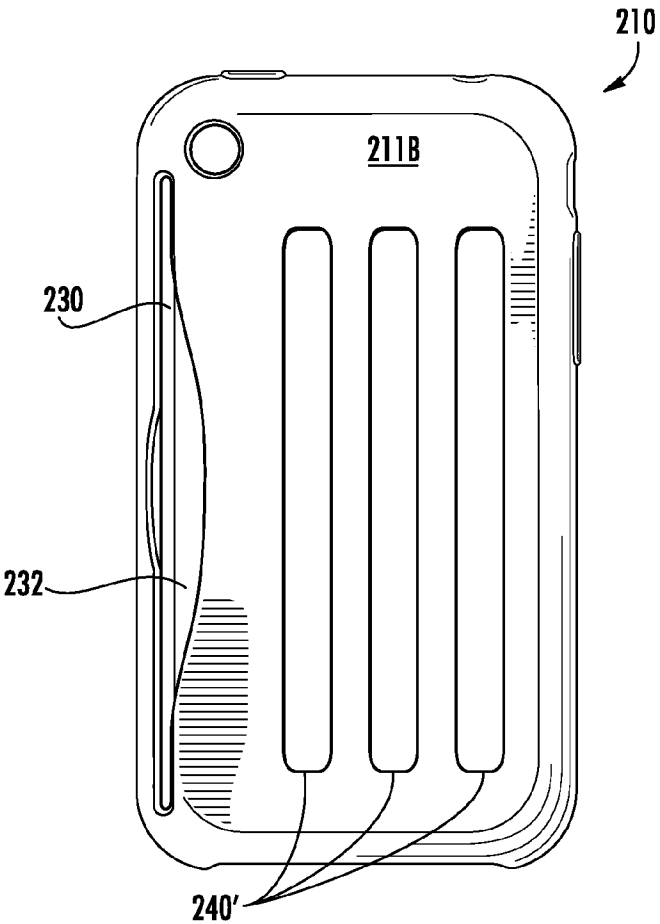
FIGS. 6A-B are rear elevation views of secondary windows formed in an electronic device protective wallet covering similar to that of FIG. 4.
Figure 6A:
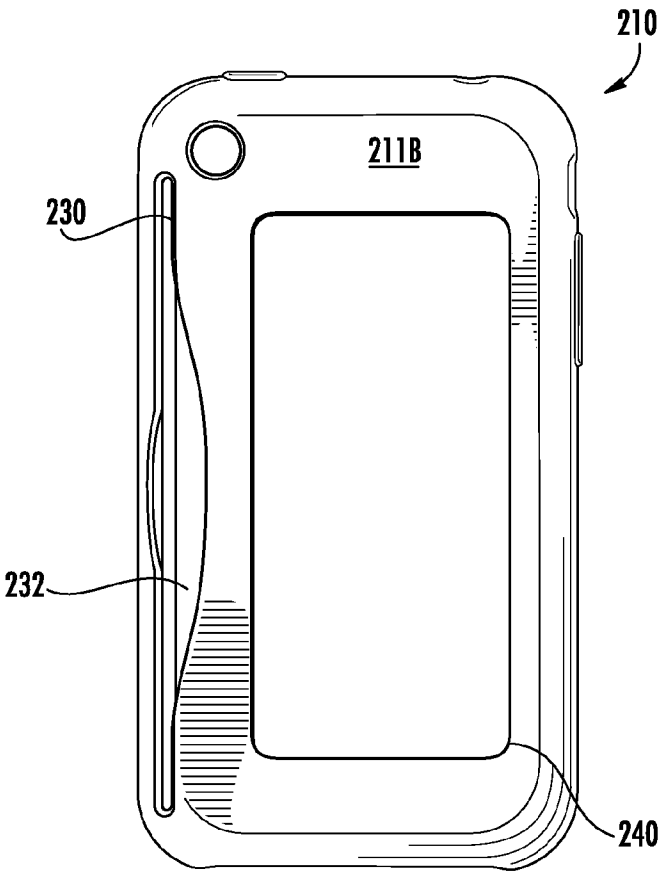

As such, as shown in FIG. 6, at least one secondary window may be provided in rear protective surface 211B to enable contents disposed in pocket 220 to be seen from the outside of covering 210. The secondary window can be of any reasonable size, depending on the desired function of the window, as long as the window is not so large that contents 300 can fall out of the window (assuming the window is an opening, see below). FIG. 6A depicts secondary window 240 taking up a fair amount of the area of rear protective face 211B. Window 240 is sufficiently large to enable someone to see the details of a piece of identification (e.g., a birth date, a month/year expiration of a commuter pass, etc.). Alternatively, it may be desirable simply to have a window that shows that something is inside the pocket without disclosing many of the details of the contents. Consequently, a smaller secondary window may be provided. For example, as shown in FIG. 6B, secondary windows 240' are narrow slits through which the presence or absence of pocket contents can be detected without revealing much information about the contents (e.g., it can be evident that paper currency is inside pocket 220, but not what denomination of currency). FIG. 6B depicts three narrow slots as windows 240', however windows 240' could be of any number and any shape, revealing any amount of the contents as desired by the manufacturer.

As with the primary window, the secondary window can be made as an opening or absence of housing material, or it could be a transparent panel or panels formed with the rear protective face 211B. The former is preferred, as it is easier and less expensive to manufacture.

Figure 7:
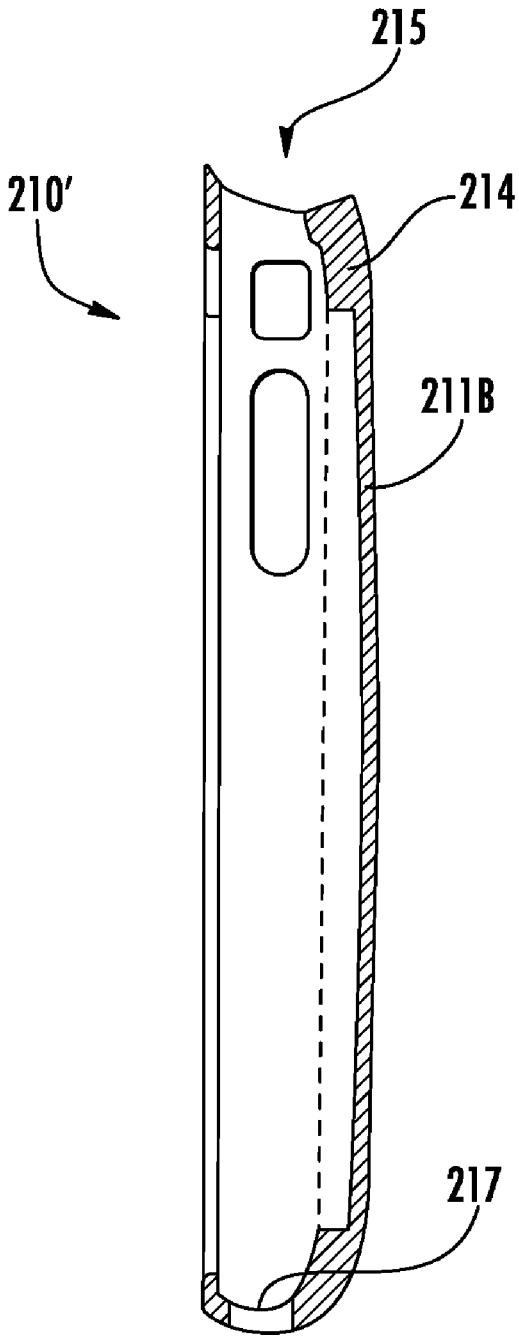
FIG. 7 is a side sectional view of an electronic device protective wallet covering similar to that of FIG. 4 having an open top.

In connection with FIGS. 4-6, covering 210 includes front face 211A, rear protective face 211B, side faces 211C, and top and bottom faces 211D for maximum protection. However, as mentioned, one or more of the front, side, top, or bottom faces 211A,C, D may be eliminated to save on materials and to make it easier to apply and remove the covering from the PDA. Eliminating one or more of the front, side, top, or bottom faces is especially advantageous if the covering is made from a hard shell substantially inelastic material. As shown in FIG. 7, covering 210' is substantially similar to covering 210 but has no top face and rather has a top opening 215. Here, the PDA may be slid into covering 210' via top opening 215. Of course, top opening 215 may be instead provided on the bottom or one (or both) of the sides. If the material is not soft and pliable, like rubber, it is preferred that it at least be somewhat resilient, in the manner of hard plastic or sheet metal. If the top (or bottom) and sides are eliminated, a resilient hinge 217 is formed at the bottom (or top) of the covering.

The invention is not limited to the above description. For example, the primary window is described and shown as being formed in the front face of the covering. However, the primary window can be made so big as to subsume the entire front, i.e., extend from side to side and from top to bottom, leaving substantially no front surface at all. Also, the figures show that the outer surface of the rear protective face is flat, that the exteriors of the first and second portions of the rear protective face are coplanar. However, they need not be coplanar; the first portion which forms the well may stick out a bit from the second portion to some extent, as long as the overall profile of the covered PDA remains pocket-sized. Other modifications are also contemplated.

Having described certain embodiments of the invention, it should be understood that the invention is not limited to the above description or the attached exemplary drawings. Rather, the invention is defined by the claims appearing hereinbelow and includes any equivalents thereof as would be appreciated by one of ordinary skill in the art.

The invention claimed is:

1. A protective wallet covering for a personal electronic digital assistant device, comprising:

a main housing having an inner housing configuration dimensioned to fit securely around a personal electronic digital assistant device, when held therein, having an outer physical device configuration, said main housing including:

a primary window disposed on a front side of said housing allowing usable access to a front surface of the personal electronic digital assistant device disposed in said housing;

a rear protective face substantially covering a rear surface of the personal electronic digital assistant device when disposed in said housing; and a planar layer, substantially extended over the rear surface of the personal electronic digital assistant device, said planar layer and said rear protective face forming a holding pocket, the cavity of said holding pocket being physically separate from the rear surface of the personal electronic digital assistant device, and adapted in size to allow insertion and removal of credit and/or business cards or folded paper currency into and out of said pocket in the manner of a wallet, said pocket further comprising a finger cut-out portion adapted to expose a portion of the contents disposed in said pocket and facilitate a user frictionally grasping and removing the contents from said pocket;

wherein said planar layer of said holding pocket comprises a smooth texture in contact with the rear surface of the personal electronic digital assistant device.

2. A protective wallet covering for a personal electronic digital assistant device according to claim 1, further comprising at least one secondary window formed in said rear protective face.

3. A protective wallet covering for a personal electronic digital assistant device according to claim 1, wherein said main housing comprises at least one of a pliable and elastic material or a hard shell made from a substantially rigid inelastic material.

4. A protective wallet covering for a personal electronic digital assistant device according to claim 1, wherein said personal electronic digital assistant device comprises a planar touch screen and said primary window comprises an absence of housing material on a front face of said main housing around said planar touch screen to thereby allow a user to have complete finger sliding access to the entire front screen surface of the personal electronic digital assistant device secured in said housing without lifting of the user's finger.

5. A protective wallet covering for a personal electronic digital assistant device according to claim 1, said primary window comprising a thin, protective and transparent material through which a user can access the front surface of the personal electronic digital assistant device secured in said housing.

6. A protective wallet covering for a personal electronic digital assistant device according to claim 1, wherein said rear protective face is substantially transparent to allow contents of said holding pocket to be visible from outside said holding pocket.

* * * * *